US011076468B2

(12) United States Patent
Lin et al.

(10) Patent No.: US 11,076,468 B2
(45) Date of Patent: Jul. 27, 2021

(54) DRIVER CIRCUIT AND LIGHTING SYSTEM FOR LIGHT APPARATUS

(71) Applicant: XIAMEN ECO LIGHTING CO. LTD., Xiamen (CN)

(72) Inventors: Liping Lin, Xiamen (CN); Wenhui Yang, Xiamen (CN); Xinghan Lai, Xiamen (CN); Tian Lan, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/798,121

(22) Filed: Feb. 21, 2020

(65) Prior Publication Data

US 2020/0196424 A1 Jun. 18, 2020

Related U.S. Application Data

(63) Continuation-in-part of application No. 16/671,735, filed on Nov. 1, 2019.

(60) Provisional application No. 62/754,054, filed on Nov. 1, 2018.

(51) Int. Cl.

| | |
|---|---|
| ***H05B 47/14*** | (2020.01) |
| ***H05B 45/325*** | (2020.01) |
| ***H05B 47/19*** | (2020.01) |

(52) U.S. Cl.

CPC ..... *H05B 47/14* (2020.01); *H05B 47/19* (2020.01)

(58) Field of Classification Search

None

See application file for complete search history.

(56) References Cited

U.S. PATENT DOCUMENTS

| | | | | |
|---|---|---|---|---|
| 10,524,334 | B1 * | 12/2019 | Price | H05B 47/19 |
| 2014/0300274 | A1 * | 10/2014 | Acatrinei | H05B 45/37 315/85 |
| 2018/0324920 | A1 * | 11/2018 | Luccato | H05B 45/10 |

* cited by examiner

*Primary Examiner* — Henry Luong

(74) *Attorney, Agent, or Firm* — Chun-Ming Shih; Lanway IPR Services

(57) ABSTRACT

The lighting apparatus includes a driver circuit and a lighting system. The driver circuit includes a signal receiver module, a signal processing module and a signal execution module. The signal receiver module is configured to receive a parameter signal of a coding device. The signal processing module is connected to the signal receiver module. The signal processing module is configured to convert the parameter signal into a PWM signal. The signal execution module is connected to the signal processing module. The signal execution module is also configured to convert an alternating current input power source into a direct current power source. The direct current power source is filtered based on the PWM signal. In this way, the filtered direct current power source matches a required power source of the lighting apparatus. The lighting apparatus solves low inapplicability and compatibility that occurs in the driver circuit of the convention art.

18 Claims, 6 Drawing Sheets

DRIVER CIRCUIT AND LIGHTING SYSTEM FOR LIGHT APPARATUS

FIELD OF THE INVENTION

The present invention relates to a lighting apparatus, and more particularly, to a driver circuit and a lighting system for a lighting apparatus.

BACKGROUND

With the rapid development of the modern industrial art, lighting apparatuses become indispensable electrical equipment for human beings' daily life. The light emitted from the lighting apparatus introduces great convenience to human beings. Considering various types of lighting demands of different industrial fields, technicians need to design different lighting devices of different specifications and/or functions. These lighting apparatuses can be applied to various technical fields, such that the lighting apparatus are employed extensively in different industrial fields. In this fashion, the lighting apparatus's practicality is getting higher.

A conventional lighting apparatus needs to get driver power through a driver circuit, such that the lighting apparatus can emit lights. However, since different types of lighting apparatuses have different requirements of stable power input. For example, a working voltage of a car light substantially stays around 12 volts, whereas a working voltage of a mobile phone light substantially stays around 36 volts. And it leads to a large difference between the working voltages of both sides. A conventional driver circuit only generates the driver power with only one specific power ratio, such that the conventional driver circuit cannot be applied in different types of lighting apparatuses. That is, such conventional driver circuit has low compatibility. Therefore, each type of lighting apparatus can only employ a specific kind of driver circuit, and it significantly increases the lighting apparatus's the manufacturing cost. In addition, the conventional lighting equipment introduces defects, such as inconvenient management, high inventory pressure and difficulty in after-sales service, to manufacturers, sellers, and after-sales services in the supply chain.

SUMMARY OF THE INVENTION

The present invention discloses a lighting system and a driver circuit thereof. And the present invention aims at neutralizing defects of low compatibility, high manufacturing cost and inexpensive application cost introduced by a conventional driver circuit that can only be applied in a specific type of lighting apparatus.

First, the present invention discloses a driver circuit of a lighting apparatus that communicates with an external coding device.

The disclosed driver circuit includes a signal receiver module, a signal processing module and a signal execution module. The signal receiver module is configured to receive a parameter signal from the external coding device. The signal processing module is connected to the signal receiver module. Also, the signal processing module is configured to convert the parameter signal into a pulse width modulation (PWM) signal. The signal execution module is connected to the signal processing module. Moreover, the signal execution module is configured to convert an alternating current input power source into a direct current input power source. In addition, the signal execution module is configured to filter the direct current input power source based on the PWM signal. Such that the filtered direct current input power source matches a predetermined power source of the lighting apparatus. The signal processing module includes a data comparing unit, a PWM signal generation unit and a signal feedback unit. The data comparing unit is connected to the signal receiver module. Also, the data comparing unit is configured to compare the parameter signal with a reference data signal to generate a digital control signal. The PWM signal generation unit is connected to the data comparing unit and the signal execution module. In addition, the PWM signal generation unit is configured to convert the digital control signal into the PWM signal. The signal feedback unit is connected between the data comparing unit and the signal receiver module. Moreover, the signal feedback unit is configured to generate a feedback signal based on a comparison result between the parameter signal and the reference data signal. Additionally, the signal feedback unit is configured to adjust internal data of the parameter signal according to the feedback signal.

In one embodiment, the reference data signal is pre-stored by the data comparison unit or is generated by a reference source.

In one embodiment, the signal processing module further includes a signal amplifying unit that is connected between the signal receiver module and the data comparison unit. In addition, the signal processing module is configured to amplify the parameter signal.

In one embodiment, the signal processing module additionally includes a A/D conversion unit that is connected between the signal receiver module and the data comparing unit. Also, the A/D conversion unit is configured to convert the parameter signal from an analog signal into a digital signal.

In one embodiment, the signal processing module further includes a RC filter unit that is connected between the PWM signal generation unit and the signal execution module. Moreover, the RC filter unit is configured to implement RC filtering on the PWM signal.

In one embodiment, the filtered direct current input power source and a predetermined power source of the lighting apparatus meet the following conditions:

$$I1=I2; \text{ and}$$

$$V1=V2;$$

I1 indicates a filtered direct current of the filtered direct current input power source. I2 indicates a predetermined current of the lighting apparatus. V1 denotes a filtered direct voltage of the filtered direct current input power source. And V2 denotes a predetermined voltage of the lighting apparatus.

In one embodiment, the external coding device is a mobile phone that supports NFC coding.

In one embodiment, the alternating current input power source includes an indoor power source.

In one embodiment, the lighting apparatus includes one of an incandescent light, a halogen light, a fluorescent light and a low pressure sodium light or a sensor light.

Second, the present invention discloses a lighting system that includes the coding device, the lighting apparatus, and the driver circuit of the lighting apparatus.

The lighting apparatus communicates with the coding device through the driver circuit. Also, the coding device generates the parameter signal. In addition, the coding device adjusts the input power source of the lighting apparatus through the parameter signal. Such that the lighting apparatus stays at a predetermined working status. The driver circuit of the lighting apparatus communicates with the coding device for data exchange. Also, the coding device transmits the parameter signal to the signal receiver module. In addition, the parameter signal includes light source control data of the light apparatus. When the signal processing module converts the parameter signal into the PWM signal, the direct current power source input by the lighting apparatus is changed via the PWM signal. Such that the direct current power source matches parameter requirements from various types of lighting apparatuses. With the aid of the direct current power source, the lighting apparatus stays at a stable and safe working status. In one embodiment, the driver circuit directly changes the input power source of the lighting apparatus according to the parameter signal. Such that the driver circuit can be applied in various types of lighting apparatuses. It leads to high compatibility, more convenience of the lighting apparatus and customized light source adjustments based on clients' demands. In this way, the lighting apparatus provides good service and experience to the clients. In this way, the driver circuit effectively solves the inapplicability and low compatibility introduced in the conventional driver circuit.

These and other objectives of the present invention will no doubt become obvious to those of ordinary skill in the art after reading the following detailed description of the preferred embodiment that is illustrated in the various figures and drawings.

DETAILED DESCRIPTION

In order to make the aims, techniques and advantages of the lighting apparatus clearer, the following will explain the driver circuit of the lighting apparatus with figures and embodiments in detailed descriptions.

Figure 1:
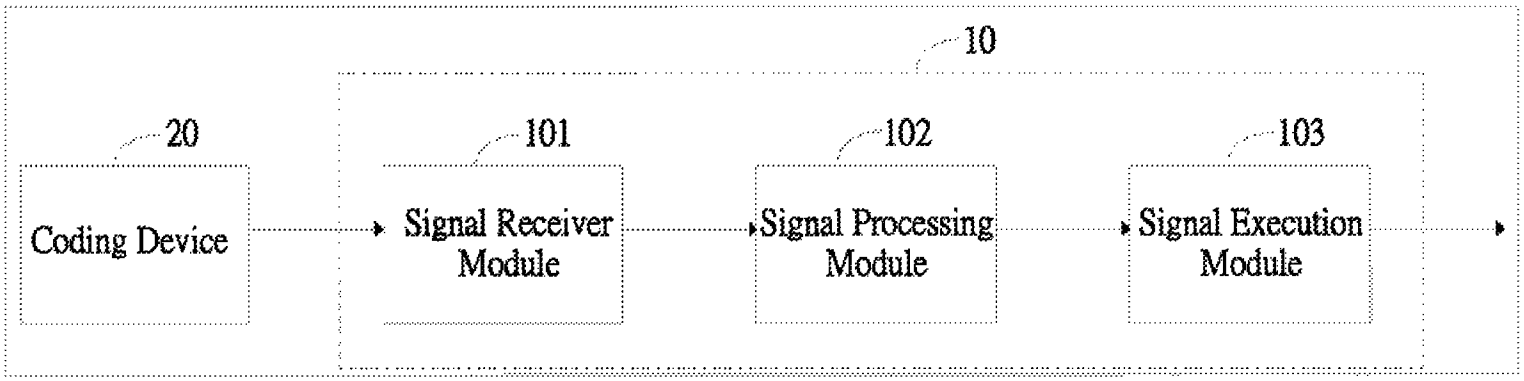
FIG. 1 is a module diagram of a driver circuit of a lighting apparatus according to some embodiment of the present invention.

FIG. 1 demonstrates a module structure of a driver circuit 10 of a lighting apparatus according to one embodiment. As FIG. 1 shows, the driver circuit 10 communicates with an external coding device 20. Such that there can be wireless data exchange between the driver circuit 10 and the coding device 20. The coding device 20 output a signal to the driver circuit 10 to change the driver circuit 10's working status. In this way, the driver circuit 10's operation performance is improved. For clear explanations, only details related to the present invention's embodiment will be described in the following paragraphs.

The driver circuit 10 includes: a signal receiver module 101, a signal processing module 102 and a signal execution module 103. The signal receiver module 101 receives a parameter signal from the coding device 20. The parameter signal includes circuit control data. With the aid of the parameter signal, the circuit control data can be used for instantly changing the driver circuit's functions. In this way, the driver circuit 10's data exchange procedure is performed. And in turn signal communication quality between the driver circuit 10 and the coding device 20 is improved.

The signal processing module 102 is connected to the signal receiver module 101. Also, the signal processing module 102 converts the parameter signal into a PWM (Pulse Width Modulation) signal. When the signal receiver module 101 transmits the parameter signal to the signal processing module 102, the signal processing module 102 is capable of performing signal function conversion. With the aid of the signal processing module 102, the PWM signal has corresponding frequency and amplitude. Such that the PWM signal can be used for performing corresponding circuit functions. On top of that, when the PWM signal's frequency and amplitude change, the driver circuit 10 correspondingly changes the lighting apparatus's working status according to the PWM signal's change. Therefore, in this embodiment, the signal processing module 102 considerably increases a control response speed of the driver circuit 10.

The signal execution module 103 is connected to the signal processing module 102. Also, the signal execution module 103 converts an alternating input power source into a direct current power source. Moreover, the signal execution module 103 filters the direct current power source based on the PWM signal. Such that the filtered direct current power source matches the required power source of the light apparatus. In addition, the signal execution module 103 directly and electrically connects to the lighting apparatus. Because the alternate input power source includes alternate electricity, the signal execution module 103 is capable of performing alternating current-direct current conversion (AC-to-DC conversion). Therefore, the direct current power output by the signal execution module 103 conforms to the electricity input demands of the lighting apparatus. Furthermore, the signal execution 103 performs PWM modulation on the direct current power source. Therefore, the lighting apparatus can instantly receive a stable direct current power source. In addition, the lighting apparatus substantially stays in a stable working status with the aid of the stable direct current power source. As a result, the lighting apparatus works in a stable manner.

In a preferred embodiment, the filtered direct current power source matches the required power source. Specifically:

The filtered direct current power source's operating parameters are equal to the operating parameters of the lighting apparatus's required power source. The operating parameters include but not limited to: voltages, currents and frequencies.

In an alternative embodiment, the signal processing module 102 includes: a data comparison unit 1021, a PWM signal generation unit 1022 and a signal feedback unit 1023.

The data comparison unit 1021 connects to the signal receiver module 101. Also, the data comparison unit 1021 compares the parameter signal with a reference data signal to generate a digital control signal.

In the embodiment, the data comparison unit 1021 is capable of comparing data. Based on the difference between the reference data signal and the parameter signal, the data comparison unit 1021 determines whether internal data of the parameter signal has normal values. In addition, based on the comparison result, the data comparison unit 1021 generates the digital control signal. Moreover, the data comparison unit 1021 amplifies the digital control signal and outputs the amplified digital control signal to the PWM signal generation unit 1022. Therefore, the PWM signal generation unit 1022 is driven to perform signal conversion. In this way, with the aid of the data comparison unit 1021, any change to the parameter signal's internal data is instantly monitored. Such that the driver circuit 10 can adjust an illuminating state of the lighting apparatus based on the parameter signal's data. In this fashion, the light apparatus's safety and stability is significantly improved.

The PWM signal generation unit 1022 connects to the data comparison unit 1021 and the signal execution module 103. Also, the PWM signal generation signal unit 1022 converts the digital control signal to the PWM signal.

The PWM signal generation unit 1022 is capable of performing pulse width modulation on the digital control signal. In addition, the PWM signal generation unit 1022 can instantly adjust internal parameters of the PWM signal. Hence, the PWM signal generation unit 1022 can have a higher signal conversion rate. Via the PWM signal, the input power of the lighting apparatus can be instantly changed. Moreover, the driver circuit 10's control response speed is also accelerated. Such that the driver circuit 10 is substantially free from control errors.

The signal feedback unit 1023 is connected between the data comparison unit 1021 and the signal receiver module 101. Based on a comparison result between the parameter signal and the reference data signal, the signal feedback unit 1023 generates a feedback signal. Furthermore, the feedback signal unit 1023 adjusts the parameter signal's internal data using the feedback signal.

According to the abovementioned descriptions, the data comparison unit 1021 is capable of retrieving an amplitude difference between the parameter signal and the reference data signal. Furthermore, the data comparison unit 1021 generates the comparison result between the parameter signal and the reference data signal. It is noted that the comparison result includes deviation information of the parameter signal's internal data. The signal feedback unit 1023 feedbacks the comparison result to the signal receiver module 101. In addition, with the aid of the comparison result, the signal feedback unit 1023 adjusts the parameter signal's internal data. Such that both the signal processing module 102 and the signal execution module 103 have better circuit control via the parameter signal. Additionally, the signal feedback unit 1023 raises the driver circuit 10's dynamic feedback performance, ensures the driver circuit 10's flexibility and stability in controlling the lighting apparatus. In this fashion, the lighting apparatus's input power always conforms to its required power requirements.

In some embodiments, the driver circuit 10 exchanges wireless data with the coding device 20. Also, the coding device 20 can control the driver circuit 10's working status. The signal execution module 103 can change the direct current power source's parameters. Such that the direct current power source fully matches the lighting apparatus's required power requirement. The driver circuit 10's circuit structure is thus simple and easy to implement. When the driver circuit 10 is applied to various types of lighting apparatuses, the driver circuit 10 always provides a stable direct current power source to the lighting apparatus 20. Such that the light apparatus 20 keeps on operating safely. The driver circuit 10 has an extremely wide application range, high controllability and reliability. Therefore, the driver circuit 10 effectively solves the problem that the conventional driver circuit fails in applications of a wide range of fields. Also, the driver circuit 10 neutralizes low compatibility and inferior usefulness introduced by the conventional driver circuit.

In an optional embodiment, the reference data signal is pre-stored by the data comparison 1021. Also, the data comparison 1021 examines whether the parameter signal stays normal with the aid of the reference data signal.

In an alternative embodiment, the reference data signal is generated by an external reference source. For example, the reference source may be implemented using a conventional reference source generating circuit. On top of that, the reference source generating circuit may instantly adjust its signal generation status based on the lighting apparatus's operation parameters. Such that the reference source in turn generates the reference data signal that matches the lighting apparatus's working status. The reference data signal is used for controlling the driver circuit 10's circuit control functions. Because the corresponding PWM signal can be used for adaptively adjusting the light apparatus's input power source, the driver circuit 10's stability and safety in controlling the lighting apparatus can be secured. In this fashion, the driver circuit 10 of the present invention's embodiment has better adaptive control.

In an alternative embodiment, the lighting apparatus includes at least one LED (Light Emitting Diode) light. When the LED light receives the required direct current power source, the LED light is driven by the required direct current power source to illuminate normally.

Figure 2:
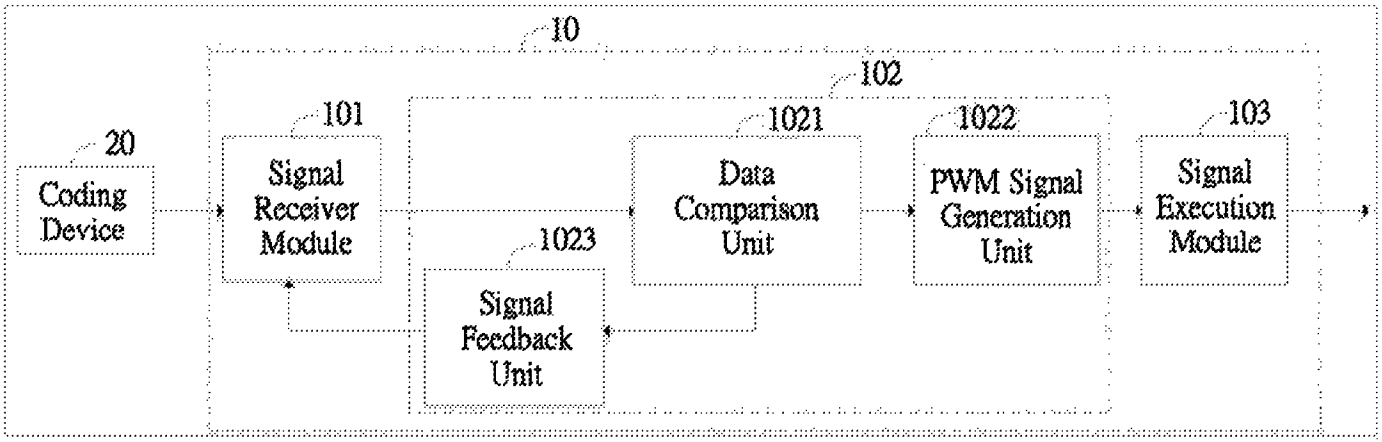
FIG. 2 is a module diagram of the driver circuit of the lighting apparatus in certain embodiment.
Figure 3:
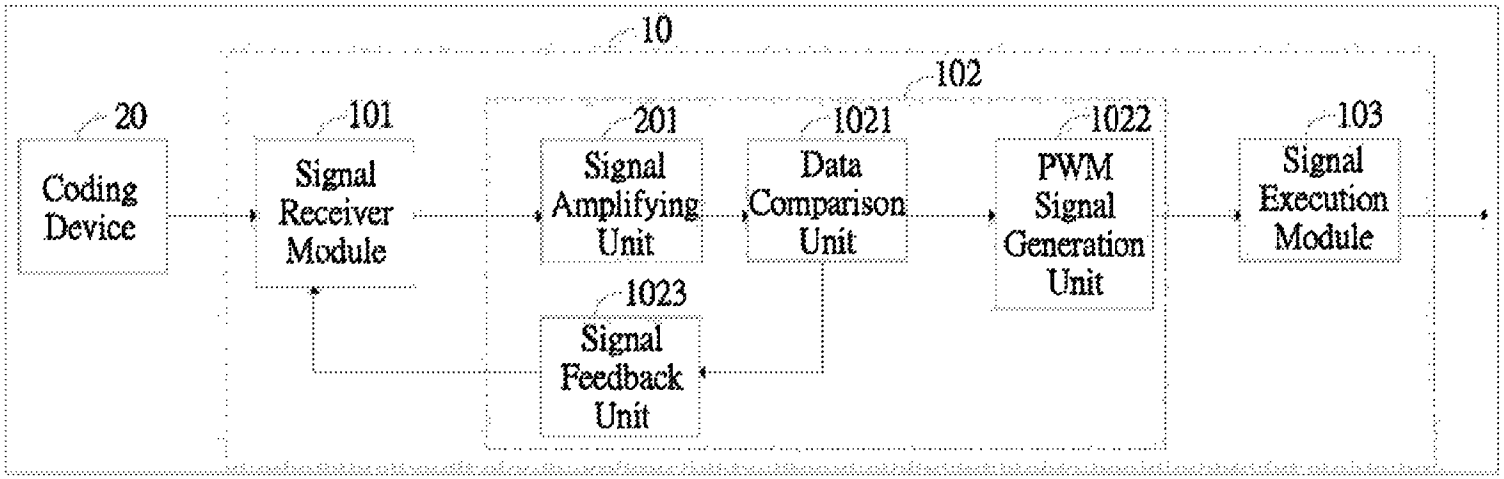
FIG. 3 is a module diagram of the driver circuit of the lighting apparatus in some embodiment.

In an alternative embodiment, FIG. 3 demonstrates the driver circuit 10's module structure. Compared to the driver circuit 10's module structure shown in FIG. 2, the signal processing module 102 in FIG. 3 includes: a signal amplifying unit 201.

The signal amplifying unit 201 is connected between the signal receiver module 101 and the data comparison unit 1021. And the signal amplifying unit 201 amplifies the parameter signal.

In one embodiment, the signal amplifying unit 201 amplifies the parameter signal to raise its power. Such that the parameter signal's data security during its transmission can be secured. Also, the driving circuit 10's control accuracy is elevated. In turn, the driving circuit 10 substantially avoids its signal distortion. When the data comparison unit 1021 receives the amplified parameter signal and compares using the received amplified parameter signal, additionally, the PWM signal generation unit 202 correspondingly implements its signal conversion. Therefore, with the aid of the PWM signal, the driver circuit 10 can accurately adjust the lighting apparatus's input power source. In this way, the lighting apparatus's operation safety is secured. Also, the driving circuit 10 raises its controllability and response speed for the lighting apparatus. And the signal transmission is faster.

Figure 4:
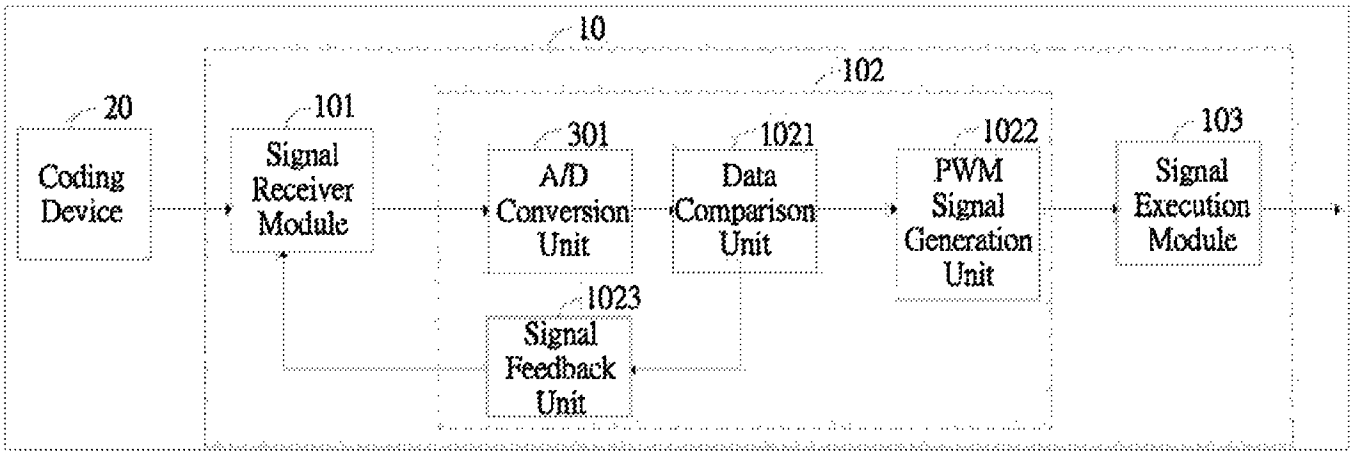
FIG. 4 is a module diagram of the driver circuit of the lighting apparatus in certain embodiment.

In an alternative embodiment, FIG. 4 shows another structure module of the driver circuit 10. Compared to the driver circuit 10's structure module shown in FIG. 2, the signal processing module 102 in FIG. 4 further includes an analog-to-digital (A/D) conversion unit 301.

The A/D conversion unit 301 is connected between the signal receiver module 101 and the data comparison unit 1021. Also, the A/D conversion unit 301 converts the parameter signal from an analog signal to a digital signal.

In the embodiment, the parameter signal output by the coding device 20 is an analog signal. For better retrieval of the parameter signal's internal data, the A/D conversion unit 301 converts the parameter signal to a digital signal and outputs the digital signal. Also, the data comparison unit 1021 and the PWM signal generation unit 302 implement data comparison and signal conversion using the parameter signal's internal data. Such that the driver circuit 10 can instantly change the lighting apparatus's input power for conforming to the lighting apparatus's power requirement. In this fashion, the A/D conversion unit 301 ensures the driver circuit 10's stable operations that render the driver circuit 10's higher compatibility.

Figure 5:
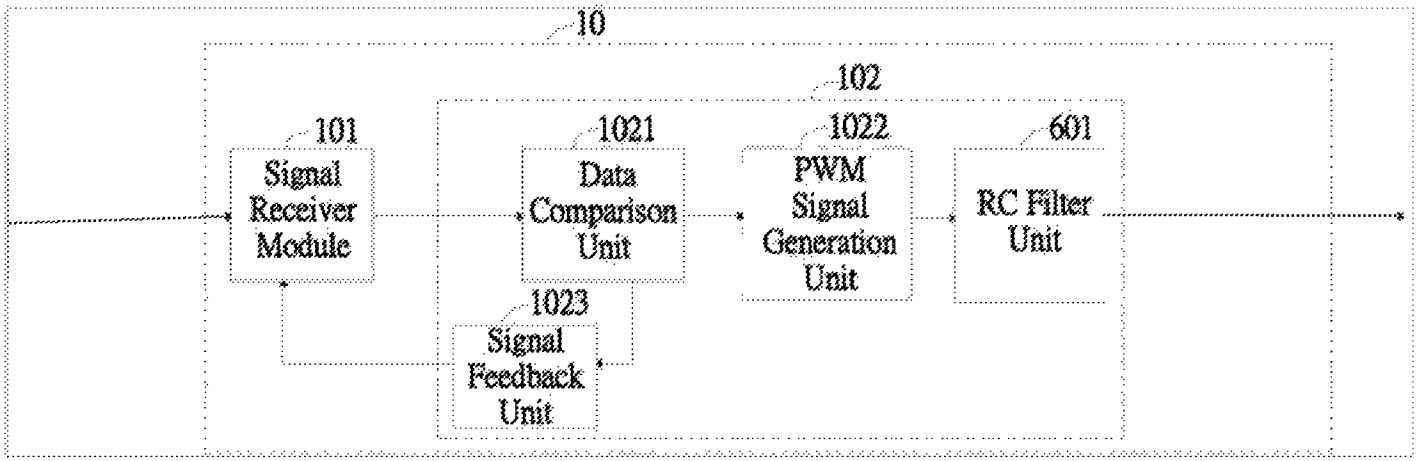
FIG. 5 is a module diagram of the driver circuit of the lighting apparatus in one embodiment.

In an alternative embodiment, FIG. 5 shows the driver circuit 10's another module structure. Compared to the driver circuit 10's module structure shown in FIG. 2, the signal processing module 102 in FIG. 5 further includes a RC filter unit 601.

The RC filter unit 601 is connected between the PWM generation unit 1022 and the signal execution module 103. Also, the RC filter unit 601 RC-filters the PWM signal.

In the embodiment, the RC filter unit 601 can filter signals. When the PWM signal generation unit 1022 outputs the PWM signal to the RC filter unit 601, the RC filter unit 601 substantially filters off noises embed within the PWM signal for raising the PWM signal's quality. Based on the filtered PWM signal, the signal execution module 103 instantly adjusts the direct current power source input by the lighting apparatus. Such that the lighting apparatus's working status is kept stable. As a result, the RC filter unit 601 elevates the driver circuit 10's stability and accuracy in control. In turn, the driver circuit 10 can be applied in various lighting apparatuses and thus achieves high practicality.

In a preferred embodiment, within the signal execution module 103, the filtered direct current power source and the required power source of the lighting apparatus meet the following conditions:

$$I1=I2 \quad (1); \text{ and}$$

$$V1=V2 \quad (2);$$

In Equation (1) and Equation (2), I1 denotes the filtered direct current of the filtered direct current power source, I2 denotes the required current of the lighting apparatus, V1 denotes the filtered direct current voltage of the filtered direct current power source, and V2 denotes the required voltage of the lighting apparatus.

In the embodiment, when parameters of the filtered direct current power source and the lighting apparatus's required current satisfy Equation (1) and Equation (2), this means that the signal execution module 102 is capable of filtering the direct current power source. Also, the filtered direct current power source fully conforms to the lighting apparatus's predetermined power requirements. Such that the lighting apparatus's working status stays stable with the aid of the filtered direct current power source. Therefore, the driver circuit 10 ensures the lighting apparatus's operational safety, strengthens its control precision, and has higher flexibility in filtering the direct current power source with the aid of the PWM signal.

In a preferred embodiment, the coding device is a smartphone that supports the NFC coding. With the aid of the NFC coding, the coding device can write and load data. In addition, the smartphone generates the parameter signal via the NFC coding. In turn, the generated parameter signal is used for changing the lighting apparatus's direct current power source.

In a preferred embodiment, the alternating input power source includes an indoor power source. The signal execution module 103 converts the indoor power source into a direct current power source that conforms to the lighting apparatus's working requirements. Such that the signal execution module 103 provides the prevalence to the driver circuit 10 in applications to various industrial fields.

In an alternative embodiment, the lighting apparatus includes at least one of an incandescent light, a halogen light, a fluorescent light and a low pressure sodium light and a sensor light. The driver circuit 10 can be applied in various types of lighting apparatuses with high compatibility. In this fashion, the driver circuit 10 ensures that the lighting apparatus receives a stable and safe power source. In this way, the lighting apparatus stays at a predetermined working status and emits a corresponding luminance. A user may control various types of lighting apparatuses' luminance through the driver circuit 10. In this way, the driver circuit 10 introduces great convenience to the user. In addition, the driver circuit 10's higher control efficiency ensures the lighting apparatus's physical safety.

It should be noted that in the embodiments above, the signal receiver module 101, the signal execution module 103, the data comparison unit 1021, the PWM generation unit 1022, the signal feedback unit 1023, the signal amplifying unit 201, the A/D conversion unit 301 and the RC filter unit 601 can all be implemented using conventional circuitry and would not be limited to the abovementioned embodiments. Exemplarily, the signal amplifying unit 201 can be implemented using a conventional signal amplifying circuit that includes electrical components such as resistors, capacitors, and operational amplifiers. Since the operational amplifier is capable of amplifying the parameter signal, the driver circuit 10 may implements the lighting apparatus's control functions in a more accurate manner with the aid of the parameter signal. In addition, the signal amplifying unit 201 has a more simplified circuitry. Such that the driver circuit 10 has lower manufacturing cost, lower application cost, and higher compatibility.

Figure 6:
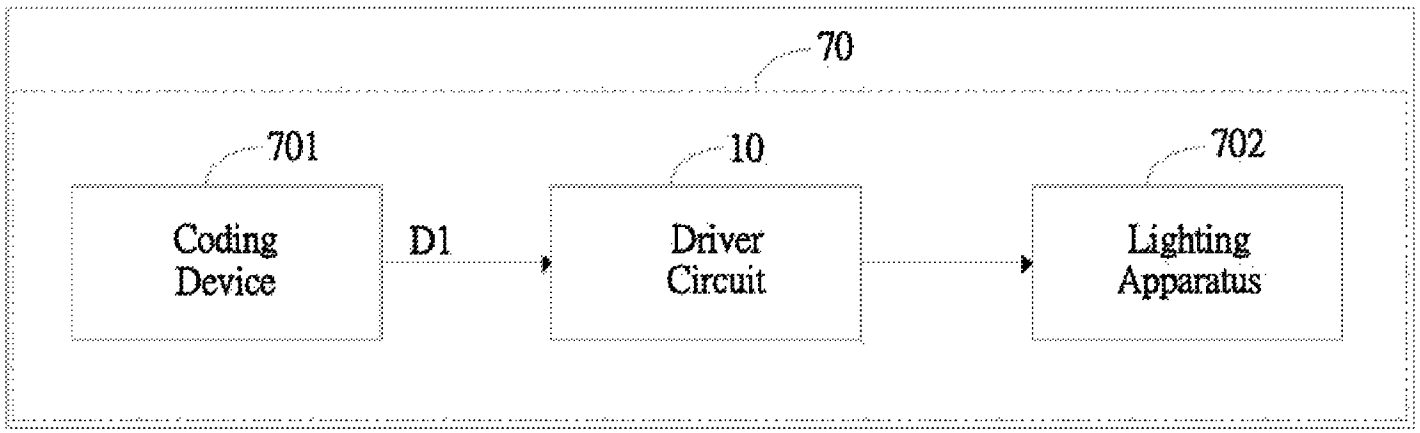
FIG. 6 is a module diagram of the lighting system in one embodiment.

FIG. 6 shows a lighting system 70's module structure according to one embodiment. As FIG. 6 illustrates, the lighting system 70 includes a coding device 701, a lighting apparatus 702 and the driver circuit 10 of the abovementioned lighting apparatus.

The lighting apparatus 702 communicates with the coding device 701 through the driver circuit 10. And the coding device 701 generates a parameter signal D1. Also, the coding device 70 adjusts the lighting apparatus 702's input power source through the parameter D1. Such that the lighting apparatus 702 stays at a predetermined working status.

Refer to the embodiments shown in FIGS. 1-5, the coding device 701 can directly control the driver circuit 10's working status via the parameter signal D1. After the driver circuit 10 converts the parameter signal D1, the driver circuit 10 directly controls the lighting apparatus 702's input power source. Such that the lighting apparatus 702's actual input power source and required power source match each other. As a result, the lighting apparatus 702 receives a stable power source, in turn stays at a normal and stable illuminating status, and thus provides comfortable visual experiences to the user. The lighting system 70 in the embodiment accurately converts an external power source into an input power source that conforms to the lighting apparatus 702's predetermined requirements. And the lighting system 70 thus ensures the lighting apparatus 702's working safety. As a result, the lighting system 70 in the embodiments has significantly high flexibility and compatibility. Also, the lighting system 70 can be extensively used in various industrial fields. In this fashion, the lighting system 70 relieves the conventional lighting apparatus of its inapplicable problem and low compatibility.

To sum up, the driver circuit of the present invention's lighting apparatus ensures that the lighting apparatus keeps on receiving a stable direct current power source. Also, the driver circuit of the present invention improves the lighting apparatus's safety and reliability and decreases its manufacturing and application cost. Therefore, the driver circuit of the present invention has significantly high compatibility and wide applicability to various types of lighting apparatuses. In this fashion, the driver circuit of the present invention is of considerable importance for lighting apparatuses' driving techniques.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A driver circuit of a lighting apparatus for communicating with an external coding device, comprising:

a signal receiver module, configured to receive a parameter signal of the external coding device;

a signal processing module, connected to the signal receiver module, and configured to convert the parameter signal into a PWM signal; and a signal execution module, connected to the signal processing module, configured to convert an alternating current input power source into a direct current power source, and configured to filter the direct current power source, such that the filtered direct current power source matches a required power source of the lighting apparatus;

wherein the signal processing module comprises:

a data comparison unit, connected to the signal receiver module, and configured to retrieve a digital control signal by comparing and amplifying between the parameter signal and a reference data signal;

a PWM signal generation unit, connected to the data comparison unit and the signal execution module, and configured to convert the digital control signal into the PWM signal; and a signal feedback unit, connected between the data comparison unit and the signal receiver module, configured to generate a feedback signal based on a comparison result between the parameter signal and the reference data signal, and configured to adjust internal data of the parameter signal based on the feedback signal.

2. The driver circuit of claim 1, wherein the reference data signal is pre-stored by the data comparison unit or generated by a reference source.

3. The driver circuit of claim 1, wherein the signal processing module further comprises: a signal amplifying unit, connected between the signal receiver module and the data comparison unit, and configured to amplify the parameter signal.

4. The driver circuit of claim 1, wherein the signal processing module further comprises: an A/D conversion unit, connected between the signal receiver module and the data comparison unit, and configured to convert the parameter signal from an analog signal to a digital signal.

5. The driver circuit of claim 1, wherein the signal processing module further comprises: a RC filter unit, connected between the PWM signal generation unit and the signal execution module, and configured to RC-filter the PWM signal.

6. The driver circuit of claim 1, wherein the filtered direct current power source and the required power source of the lighting apparatus meeting the following conditions:

$$I1=I2; \text{ and}$$

$$V1=V2;$$

wherein I1 denotes a filtered direct current of the filtered direct current power source, I2 denotes a required current of the required power source, V1 denotes a filtered direct current voltage of the filtered direct current power source, and V2 denotes a required voltage of the required power source.

7. The driver circuit of claim 1, wherein the coding device comprises a smartphone that supports an NFC coding.

8. The driver circuit of claim 1, wherein the alternating current input power source comprises an indoor power source.

9. The driver circuit of claim 1, wherein the lighting apparatus comprises at least one of an incandescent light, a halogen light, a fluorescent light, a low pressure sodium light and a sensor light.

10. A lighting system, comprising:

a coding device;

a lighting apparatus; and a driver circuit, comprising:

a signal receiver module, configured to receive a parameter signal of the coding device;

a signal processing module, connected to the signal receiver module, and configured to convert the parameter signal into a PWM signal; and a signal execution module, connected to the signal processing module, configured to convert an alternating current input power source into a direct current power source, and configured to filter the direct current power source, such that the filtered direct current power source matches a required power source of the lighting apparatus;

wherein the signal processing module comprises:

a data comparison unit, connected to the signal receiver module, and configured to retrieve a digital control signal by comparing and amplifying between the parameter signal and a reference data signal;

a PWM generation unit, connected to the data comparison unit and the signal execution module, and configured to convert the digital control signal into the PWM signal; and a signal feedback unit, connected between the data comparison unit and the signal receiver module, configured to generate a feedback signal based on a comparison result between the parameter signal and the reference data signal, and configured to adjust internal data of the parameter signal based on the feedback signal;

wherein the lighting apparatus is configured to communicate with the coding device via the driver circuit;

wherein the coding device is configured to generate the parameter signal, and configured to adjust an input power source of the lighting apparatus according to the parameter signal, such that the lighting apparatus stays at a required operating status.

11. The lighting system of claim 10, wherein the reference data signal is pre-stored by the data comparison unit or is generated by a reference source.

12. The lighting system of claim 10, wherein the signal processing module further comprises: a signal amplifying unit, connected between the signal receiver module and the data comparison unit, and configured to amplify the parameter signal.

13. The lighting system of claim 10, wherein the signal processing module further comprises: an A/D conversion unit, connected between the signal receiver module and the data comparison unit, and configured to convert the parameter signal from an analog signal to a digital signal.

14. The lighting system of claim 10, wherein the signal processing module further comprises: a RC filter unit, connected between the PWM signal generation unit and the signal execution module, and configured to RC-filter the PWM signal.

15. The lighting system of claim 10, wherein the filtered direct current power source and the required power source of the lighting apparatus meet the following conditions:

$$I1=I2; \text{ and}$$

$$V1=V2;$$

wherein I1 denotes the filtered direct current of the filtered direct current power source, I2 denotes the required current of the required power source, V1 denotes the filtered direct current voltage of the filtered direct current power source, and V2 denotes the required voltage of the required power source.

16. The lighting system of claim 10, wherein the coding device comprises a smartphone that supports an NFC coding.

17. The lighting system of claim 10, wherein the alternating current input power source comprises an indoor power source.

18. The lighting system of claim 10, wherein the lighting apparatus comprises at least one of an incandescent light, a halogen light, a fluorescent light, a low pressure sodium light and a sensor light.

* * * * *